US005591926A

United States Patent [19]

Inada et al.

[11] Patent Number: 5,591,926

[45] Date of Patent: Jan. 7, 1997

[54] SILVER BASE ELECTRICAL CONTACT MATERIAL

[75] Inventors: Hayato Inada, Moriguchi; Koji Tsuji, Nara, both of Japan

[73] Assignee: Matsushita Electric Works, Ltd., Kadoma, Japan

[21] Appl. No.: 534,203

[22] Filed: Sep. 26, 1995

[30] Foreign Application Priority Data

Sep. 28, 1994 [JP] Japan ..... 6-232950

[51] Int. Cl.[6] ..... C22C 5/06

[52] U.S. Cl. ..... 75/247; 75/232

[58] Field of Search ..... 75/232, 247

[56] References Cited

U.S. PATENT DOCUMENTS

| | | | |
|---|---|---|---|
| 3,799,771 | 3/1974 | Harada | 75/178 A |
| 4,699,763 | 10/1987 | Sinharoy et al. | 419/11 |
| 4,808,223 | 2/1989 | Ozaki et al. | 75/235 |
| 4,834,939 | 5/1989 | Bornstein | 419/21 |
| 4,874,430 | 10/1989 | Bornstein | 75/234 |
| 5,022,932 | 6/1991 | Yamada et al. | 148/13.1 |
| 5,198,015 | 3/1993 | Tsuji et al. | 75/247 |

FOREIGN PATENT DOCUMENTS

| | | |
|---|---|---|
| 58-126607 | 7/1983 | Japan . |
| 59-6342 | 1/1984 | Japan . |
| 59-159951 | 9/1984 | Japan . |
| 59-153852 | 9/1984 | Japan . |
| 4-107232 | 4/1992 | Japan . |

OTHER PUBLICATIONS

ASM Handbook, vol. 7, Powder Metallurgy, 1984, pp. 630–634.

*Primary Examiner*—Charles T. Jordan
*Assistant Examiner*—Daniel Jenkins
*Attorney, Agent, or Firm*—Armstrong, Westerman, Hattori, McLeland & Naughton

[57] ABSTRACT

A silver base electrical contact material is described which contains uniformly in a silver matrix dispersed particles of nickel, nickel oxide, and at least one additive selected from the group consisting of vanadium, manganese, chromium, thallium, titanium, cobalt, and tungsten carbide. The contact material contains 1.3 to 24.8 wt % of nickel, 0.2 to 4.7 wt % of nickel oxide, 0.05 to 3 wt % of the additive, and balance silver. A superior silver base contact material having excellent welding and wear resistances is obtained by adding the metals and the metal carbide to a silver-nickel-nickel oxide contact material.

2 Claims, No Drawings

SILVER BASE ELECTRICAL CONTACT MATERIAL

FIELD OF THE INVENTION

The present invention relates to a silver base contact material used in electrical contact devices.

BACKGROUND OF THE INVENTION

A contact material used in electrical devices such as relays and magnetic switches, and circuit breakers is often made from an Ag including additives for improving its contact qualities, namely, wear resistance, welding resistance, and contact resistance.

A typical additive to the Ag, for example, is metal oxide. In particular, an Ag-CdO contact material has low contact resistance, good welding resistance, and good wear resistance; however, it is environmentally unsafe since it contains Cd, a highly toxic metal. Another example for metal oxide added to the Ag is $SnO_2$. An Ag-$SnO_2$ contact material has excellent welding resistance and good wear resistance, but the contact material has, unfortunately, high contact resistance.

Instead of these metal oxides, it has been proposed to add W (tungsten) to the Ag. As a result, an Ag-W contact material has excellent welding resistance, but the contact material has, unfortunately, poor wear resistance and high contact resistance. Moreover, it has been known that the addition of Ni to the Ag improves electrical conductivity of an Ag base contact material and working ability, in processing a contact material into contact wires or rivets, thereof. Yet, only a problem is that an Ag-Ni contact material has poor welding resistance compared with those of the Ag-metal oxide contact materials. Therefore, in order to improve the welding resistance of the Ag-Ni contact material, various additives have been added to the Ag-Ni contact material individually or as a combination of the additives.

These additives are disclosed in the following publication listed below.

LIST OF PRIOR ART PUBLICATIONS (1) U.S. Pat. No. 5,198,015;

(2) U.S. Pat. No. 4,834,939;

(3) U.S. Pat. No. 4,874,430;

(4) Japanese Patent Non-Examined Early Publications (KOKAI) No. 4-107232;

(5) Japanese Patent Non-Examined Early Publications (KOKAI) No. 59-159951;

(6) Japanese Patent Non-Examined Early Publications (KOKAI) No. 59-153852;

(7) Japanese Patent Non-Examined Early Publications (KOKAI) No. 59-6342; and (8) Japanese Patent Non-Examined Early Publications (KOKAI) No. 58-126607.

The publication (1) describes an Ag-Ni contact material in which submicron NiO particles, completely separated from submicron and micron Ni particles, are dispersed in an Ag matrix. The presence of the NiO particles, incorporated with the micron Ni particles, reduces a high concentration of arc discharges on the contact material surface, leading to improve the welding resistance of the Ag-Ni contact material.

The publications (2) and (3) describe an Ag base electrical contact material containing Ni and CdO. In these cases, Ni particles are surrounded by a continuous adherent coating of NiO in order to prevent the detrimental chemical reaction between Ni and CdO, leading to the prolongation of a lifetime of the contact material.

The publication (4) discloses an effect of the addition of WC (tungsten carbide) particles having an average diameter of 1 μm or less to the Ag-Ni contact material in order to improve welding resistance of the material without interference of its wear resistance.

The publication (5) explains an effect of the addition of at least two selected from the group consisting of Ti, Ta, Zr, and Cr to the Ag-Ni contact material. The presence of these metal particles enables to prevent effectively the contact material from welding caused by arc discharges developed at contacts.

The publications (6) and (7) disclose effects of the addition of at least one selected from the group consisting of Ti, W, Mo, and Cr to the Ag-Ni contact material. In both cases, the added metal is blended to the contact material such that welding resistance is strengthened.

The publication (8) describes an effect of the addition of at least one selected from the group consisting of W, Cr, and Mo to the Ag-Ni contact material. Although there is no direct improvement on the welding resistance of the Ag-Ni contact material in this case, the added metal is employed to decrease the contact resistance of the Ag-Ni contact material without interfering the welding resistance.

In spite of these efforts, all of the Ag-Ni contact materials above result in having weaker welding and wear resistances than those of the Ag-CdO and Ag-$SnO_2$ contact materials.

Nevertheless, among these Ag-Ni contact materials, it appears that the Ag-Ni-NiO contact material has welding resistance as good as that of the Ag-CdO and that the material has, unsuccessfully, weaker welding resistance compared with that of the Ag-$SnO_2$. Therefore, it is desirable to improve the welding resistance of the Ag-Ni-NiO contact material in order to obtain a superior Ag base contact material.

SUMMARY OF THE INVENTION

The present invention pertains to a superior Ag base electrical contact material essentially consisting of: (i) 1.3–24.8 wt % of Ni; (ii) 0.2–4.7 wt % of NiO; (iii) 0.05–3 wt % of at least one additive selected from the group consisting of V, Mn, Cr, Ta, Ti, Co, and WC; and (iv) the balance Ag.

A process of making the contact material above is, firstly, to prepare an Ag-Ni alloy powder obtained by melting a mixture of Ag and Ni at temperature of approximately 1,650° C. to form a molten Ag-Ni liquid containing 1 to 5 wt % of Ni and then rapidly cooling the molten liquid through the water-atomization process. After this process, the Ag-Ni alloy powder has a microscopic structure such that submicron Ni particles are dispersed in the oxygen contained Ag matrix. The process of making the Ag-N alloy powder is described in great detail in the listed publication (1) of U.S. Pat. No. 5,198,015.

Secondly, the resulting Ag-Ni alloy powder containing the submicron Ni particles uniformly dispersed in the Ag matrix is blended with the carbonyl Ni powder and the additive powder so as to be formed into a cylindrical billet which is subsequently sintered. In this sintering process, some of the submicron Ni particle in the Ag-Ni alloy powder are reacted with the oxygen and oxidized to submicron NiO particles; micron Ni particles produced from sintering the carbonyl Ni powder in the blended powder and micron additive particles are also dispersed in the Ag matrix.

Thirdly, the resulting sintered product is processed through hot-extrusion, swaging, and wire-drawing into a wire with a considerably reduced cross section.

Finally, the wire is cut to a suitable length and forged into a rivet-shape contact.

The Ni and NiO particles are used to strengthen the contact qualities of an Ag base contact. Specifically, the micron Ni particles improve wear resistance with good cohesion to the Ag matrix; the submicron Ni particles improve welding resistance; and the submicron NiO particles improve the welding resistance, stabilize contact resistance and arc resistance.

In this invention, we determined that a preferred average diameter of the micron Ni particles is 1 to 20 μm, a preferred average diameter of the submicron Ni particles is 1 μm or less, a preferred average diameter of the NiO particles is 1 μm or less, and a preferred average diameter of particles of the selected additive is 10 μm or less.

A novelty of the invention directed to the addition of (iii) to a contact material composed of (i), (ii), and (iv); those amounts and particle diameters of the ingredients are essential parameters for further improvement on welding resistance as well as wear resistance of the Ag contact material. The invention contact material has improved welding resistance which is comparable to those of the Ag-$SnO_2$ contact material and excellent wear resistance.

DETAILED DESCRIPTION OF THE PREFERRED EMBODIMENT

A silver base electrical contact material in accordance with the present invention is made from a blend of an Ag-Ni alloy powder containing of Ni, a carbonyl Ni powder, and at least one additive powder selected from the group consisting of V, Mn, Cr, Ta, Ti, Co, and WC, and the resulting contact material essentially contains 1.3–24.8 wt % of Ni, 0.2–4.7 wt % of NiO, 0.05–3 wt % of additive, and balance Ag.

The Ag-Ni alloy powder is obtained by firstly melting a mixture of Ag and Ni at temperature of approximately 1,650° C. to form a molten liquid containing 1 to 5 wt % of Ni and then rapidly cooling the molten liquid through the water-atomization process, which is described in great details in the publication (1) of U.S. Pat. No. 5,198,015.

The resulting Ag-Ni alloy powder containing Ni particles uniformly dispersed in the oxygen contained Ag matrix is blended with the carbonyl Ni powder and the additive powder so as to be formed into a cylindrical billet which is subsequently sintered. The resulting sintered product is processed through hot-extrusion, swaging, and wire-drawing into a wire with a considerably reduced cross section. Finally, the wire is cut to a suitable length and forged into a rivet-shape contact.

The Ag-Ni alloy powder is made to have an average particle diameter of not more than 45 μm, preferably 20 μm or less, in order to be uniformly blended with the carbonyl Ni powder and an additive powder of one selected from the group of V, Mn, Cr, Ta, Ti, Co, and WC. It is possible to use more than two kinds of additive powders selected from the group described above. Also, the Ag-Ni powder is made to precipitate submicron Ni particles having an average particle diameter of not more than 1 μm, preferably having a particle diameter of 0.2 to 1 μm. Since the molten liquid contains Ni in a limited amount of 1 to 5 wt %, there appears no coarse Ni grains having a particle diameter of more than 10 μm, which would certainly deteriorate sintering effect, formability, and eventually lower welding resistance of the contact material if the Ni grains are intermingled with the Ag-Ni alloy powder. Furthermore, since Ni in an amount of not more than 5 wt % can be entirely dissolved to form the molten liquid, then it is expected to precipitate Ni completely as submicron Ni particles.

It should be noted that the Ag-Ni alloy powder contains oxygen during the water-atomization process, from the high pressurized water, and that the oxygen reacts to oxidize the Ni particles into NiO particles in the subsequent sintering process. An amount of the oxygen taken and a powder diameter in the alloy powder can be controlled by varying the water pressure in the water-atomization process. The oxygen content of the Ag-Ni alloy powder should be in a range of 0.05 to 1 wt % so as to produce the required amount of NiO particles, that is 0.2 to 4.7 wt %, dispersed in the Ag matrix.

The Ag-Ni alloy powder is blended with the carbonyl Ni powder having an average particle diameter of 10 μm and the additive powder having an average particle diameter of 1 μm. The blended powders are press-formed into a cylindrical billet. The billet is vacuum-sintered at 850° C. for 2 hours, hot-compressed twice at 420° C. in order to obtain a sintered body, pre-heated at 800° C., hot-extruded at 420° C., and shaped into a wire. After this sintering process, micron Ni particles and micron additive particles, in addition to the submicron Ni particles and the submicron NiO particles (produced by oxidizing the submicron Ni particles), are dispersed in the Ag matrix to strengthen the matrix. A very minute amount of submicron Ni particles formed from the carbonyl Ni powder is also present in the Ag matrix.

A preferred average diameter of the micron Ni particles is 1 to 20 μm, a most preferred range for the average diameter is 3–10 μm, and an average diameter of the submicron Ni particles is 1 μm or less. If the diameter of micron Ni particles is greater than 20 μm, then it results in decreasing the welding resistance and sintering ability. A preferred average diameter of NiO is 1 μm or less for improvement of the wear resistance. A preferred average diameter of the additive particles uniformly distributed in the Ag matrix is 10 μm or less.

The above NiO content can be calculated based on an oxygen equivalent concentration which can be readily obtained by a combustion infrared absorption method.

A preferred Ni content is 1.3–24.8 wt %. If the Ni content is less than 1.3 wt %, then there is no improvement on welding resistance of the contact material. If the content is greater than 24.8 wt %, then it is difficult to maintain good contact resistance of the contact material. A preferred NiO content is 0.2–4.7 wt %. If the NiO content is less than 0.2 wt %, then improvement on welding and wear resistances of the contact material are small. If the content is greater than 4.7 wt %, then working ability of the contact material is considerably decreased. A preferred content of the additive is 0.05–3 wt %. If the content is less than 0.05 wt %, then no improvement on welding resistance and wear resistance occurs. If the content is greater than 3 wt %, then significant decreases on the welding resistance and the wear resistance occur.

The contact material of this invention contains the Ni particles, the NiO particles which are electrically nonconductive and have a higher melting point than the Ni particles, and the selected additive particles which also have high melting point and electrically conductive in the Ag matrix. The addition of the additive provides the following effects with respect to the Ag-Ni-NiO contact material: (a) maintaining conductivity of the Ag-Ni-NiO contact material, (b) reinforcing the Ag matrix without interfering the conductivity, and (c) improving the welding resistance and wear resistance caused by a temperature increase, owing to low electrically conductive, of the contact material.

Therefore, the purpose of blending the additive is to strengthen the Ag matrix even more effectively against wear and welding than an Ag-Ni-NiO contact material. Specifically, because of the presence of the additive in the Ag matrix, an amount of wear per a make-break operation, that is a switching operation, is reduced; as a consequence, wear resistance of the Ag base contact material is improved. Moreover, since the melting point of the additive is high, the contact material contained the additive persists against high energy arcs generated in breaks of the contact. Thus, the presence of the additive increases anti-arc property of the contact material more significantly.

The rivet-shape contacts formed from the wire are examined for their welding resistances and wear resistances in accordance with ASTM (American Society for Testing and Materials). The ASTM test is performed under make-break conditions of 100 volts, 40 amperes in ambient air with a resistive load. The number of make-break operations was 50,000, and a time length elapsed for a single make-break operation was 1 second. In addition to these contact qualities, working ability in manufacturing the rivet from the wire via the sintered body is also an important quality of the contact material.

EXAMPLE 1

Ag and Ni were melted in a high frequency induction furnace at approximately 1,650° C.; a molten Ag-Ni liquid was atomized by using the water-atomization process in which a high pressure water jet was applied to the molten liquid in order to solidify the liquid into an Ag-Ni alloy powder. This alloy powder contained 3.2 wt % Ni. A particle distribution of Ni in this alloy powder was analyzed by using a scanning electron micrograph. The presence of Ag and Ni was confirmed by using an X-ray diffraction analysis. And an oxygen content of the alloy powder was analyzed by the combustion infrared absorption method.

Then a Ni carbonyl powder having an average particle diameter of 10 μm and a V (vanadium) powder, an additive powder, having an average particle diameter of 1 μm were mixed with the Ag-Ni alloy powder above.

The Ag-Ni alloy powder was compacted into a cylindrical billet; this billet was vacuum-sintered for 2 hours at 850° C., and then hot-compressed twice at 420° C. in the axial direction of the cylindrical billet in order to obtain a sintered body. The presence of NiO in the sintered body was conformed by using an X-ray diffraction analysis; some of the submicron Ni particles were oxidized chemically to submicron NiO particles.

The sintered body was pre-heated at 800° C. and, consequently, heat-extruded at 420° C. into a wire having a diameter of 8 mm. The wire was swaged and further drawn such that its diameter was reduced to 2 mm.

A content of oxygen of 0.2 wt % in the wire (its diameter of 2 mm) of the invention contact material was determined, as mentioned previously, by using the combustion infrared absorption method. From this oxygen content, a content of NiO was calculated to be 1 wt %. An amount of Ni particles was 9 wt %, a total Ni content, the sum of the amounts of the Ni particles and Ni in the NiO, was 9.8 wt %, a V content was 1 wt %, and the rest was Ag.

The Ag-Ni-NiO-V wire was processed into header-formed rivets used as samples for the determination of contact qualities: welding resistance and wear resistance of the contact material. These contact qualities were tested by the ASTM tester under the make-break conditions explained above. The numbers of contact welding and the contact wear listed in TABLE I were expressed as an average test value of twelve sample rivets.

EXAMPLE 2

An Ag-Ni-NiO-Mn contact material was prepared by using the identical process described in Example 1 except the addition of a Mn (manganese) powder having an average particle diameter of 1 μm instead of the V powder. The material contained 9 wt % Ni, 1 wt % NiO, 1 wt % Mn, and the balance Ag. Rivet test contacts were prepared from the material. Contact qualities of the test contacts were examined by the ASTM tester under the make-break conditions explained above.

EXAMPLE 3

An Ag-Ni-NiO-Cr contact material was prepared by using the identical process described in Example 1 except the addition of a Cr (chromium) powder having an average particle diameter of 1 μm. Rivet test contacts were prepared from the material. The material contained 9 wt % Ni, 1 wt % NiO, 1 wt % Cr, and the balance Ag. Contact qualities of the test contacts were examined by the ASTM tester under the make-break conditions explained above.

EXAMPLE 4

An Ag-Ni-NiO-Ta contact material was prepared by using the identical process described in Example 1 except the addition of a Ta (thallium) powder having an average particle diameter of 1 μm. Rivet test contacts were prepared from the material. The material contained 9 wt % Ni, 1 wt % NiO, 1 wt % Ta, and the balance Ag. Contact qualities of the test contacts were examined by the ASTM tester under the make-break conditions explained above.

EXAMPLE 5

An Ag-Ni-NiO-Ti contact material was prepared by using the identical process described in Example 1 except the addition of a Ti (titanium) powder having an average particle diameter of 1 μm. Rivet test contacts were prepared from the material. The material contained 9 wt % Ni, 1 wt % NiO, 1 wt % Ti, and the balance Ag. Contact qualities of the test contacts were examined by the ASTM tester under the make-break conditions explained above.

EXAMPLE 6

An Ag-Ni-NiO-Co contact material was prepared by using the identical process described in Example 1 except the addition of a Co (cobalt) powder having an average particle diameter of 1 μm. The material contained 9 wt % Ni, 1 wt % NiO, 1 wt % Co, and the balance Ag. Rivet test contacts were prepared from the material. Contact qualities of the test contacts were examined by the ASTM tester under the make-break conditions explained above.

EXAMPLE 7, 8, and 9

Ag-Ni-NiO-WC contact materials were prepared by using the identical process described in Example 1 except the additions of a WC (tungsten carbide) powder having an average particle diameter of 1 μm. Rivet test contacts were prepared from these materials. Contact qualities of the test contacts were examined by the ASTM tester under the make-break conditions explained above. Excellent welding resistances were observed in these examples.

The first contact material for EXAMPLE 7 contained 9 wt % Ni, 1 wt % NiO, 0.1 wt % WC, and the balance Ag; the second contact material for EXAMPLE 8 contained 9 wt % Ni, 1 wt % NiO, 1 wt % WC, and the balance Ag; and the third contact material for EXAMPLE 9 contained 9 wt % Ni, 1 wt % NiO, 3 wt % WC, and the balance Ag.

EXAMPLE 10

An Ag-Ni-NiO-WC-Ta contact material was prepared by using the identical process described in Example 1 except the additions of WC and Ta powders both having an average particle diameter of 1 μm. The material contained 9 wt % Ni, 1 wt % NiO, 0.5 wt % WC, 0.5 wt % Ta, and the balance Ag. Rivet test contacts were prepared from the material. Contact qualities of the test contacts were examined by the ASTM tester under the make-break conditions explained above.

EXAMPLE 11

An Ag-Ni-NiO-WC-Ti contact material was prepared by using the is identical process described in Example 1 except the additions of WC and Ti powders both having an average particle diameter of 1 μm. The material contained 9 wt % Ni, 1 wt % NiO, 0.5 wt % WC, 0.5 wt % Ti, and the balance Ag. Rivet test contacts were prepared from the material. Contact qualities of the test contacts were examined by the ASTM tester under the make-break conditions explained above.

EXAMPLE 12

An Ag-Ni-NiO-Ti-V contact material was prepared by using the identical process described in Example 1 except the additions of Ti and V powders both having an average particle diameter of 1 μm. The material contained 9 wt % Ni, 1 wt % NiO, 0.5 wt % Ti, 0.5 wt % V, and the balance Ag. Rivet test contacts were prepared from the material. Contact qualities of the test contacts were examined by the ASTM tester under the make-break conditions explained above.

COMPARATIVE EXAMPLE 1

Rivet test contacts were made from an Ag-Ni-NiO-WC contact material provided by using the identical process described in Example 7, 8, and 9 except the addition of a large amount of a WC powder having an average particle diameter of 1 μm. The contact material contained 9 wt % Ni, 1 wt % NiO, 5 wt % WC, and the balance Ag. Contact qualities of the test contacts were examined by the ASTM tester under the make-break conditions explained above.

It was concluded that the large amount of WC shows a detrimental effect on wear resistance of the contact material.

COMPARATIVE EXAMPLE 2

Rivet test contacts were made from an Ag-Ni-NiO contact material, the prior art contact material, provided by using the identical process described in Example 1 except the absence of selected additive. The material contained 9 wt % Ni, 1 wt % NiO, and the balance Ag. Contact qualities of the test contacts were examined by the ASTM tester under the make-break conditions explained above.

All of the contact materials prepared in Examples 1–9 had superior welding and wear resistances to the prior art contact material of comparative example 2. And the contact material of comparative example 1 showed the detrimental effect on wear resistance because of the large amount of WC, however indicating superior welding resistance.

TABLE I

| | COMPOSITION (wt %) | | | | Total Ni content | $O_2$ content | The number of contact welding | Contact wear |
|---|---|---|---|---|---|---|---|---|
| | Ni | NiO | Additive | Ag | (wt %) | (wt %) | (number) | (mg) |
| EXAMPLE 1 | 9 | 1 | 1 (V) | balance | 9.8 | 0.2 | 1.3 | 3.8 |
| EXAMPLE 2 | 9 | 1 | 1 (Mn) | balance | 9.8 | 0.2 | 1.3 | 2.4 |
| EXAMPLE 3 | 9 | 1 | 1 (Cr) | balance | 9.8 | 0.2 | 4.3 | 3.9 |
| EXAMPLE 4 | 9 | 1 | 1 (Ta) | balance | 9.8 | 0.2 | 1.3 | 2.5 |
| EXAMPLE 5 | 9 | 1 | 1 (Ti) | balance | 9.8 | 0.2 | 4.3 | 1.6 |
| EXAMPLE 6 | 9 | 1 | 1 (Co) | balance | 9.8 | 0.2 | 3.3 | 2.1 |
| EXAMPLE 7 | 9 | 1 | 0.1 (WC) | balance | 9.8 | 0.2 | 0 | 2.7 |
| EXAMPLE 8 | 9 | 1 | 1 (WC) | balance | 9.8 | 0.2 | 0 | 3.4 |
| EXAMPLE 9 | 9 | 1 | 3 (WC) | balance | 9.8 | 0.2 | 0 | 4.2 |
| EXAMPLE 10 | 9 | 1 | 0.5 (WC)<br>0.5 (Ta) | balance | 9.8 | 0.2 | 0 | 2.8 |
| EXAMPLE 11 | 9 | 1 | 0.5 (WC)<br>0.5 (Ti) | balance | 9.8 | 0.2 | 2.5 | 2.1 |
| EXAMPLE 12 | 9 | 1 | 0.5 (Ti)<br>0.5 (V) | balance | 9.8 | 0.2 | 1.1 | 2.0 |
| COMPARATIVE EXAMPLE 1 | 9 | 1 | 5 (WC) | balance | 9.8 | 0.2 | 0 | 9.9 |
| COMPARATIVE EXAMPLE 2 | 9 | 1 | — | balance | 9.8 | 0.2 | 5.6 | 5.2 |

What is claimed is:

1. A silver base electric contact material essentially consisting of:

a) 1.3 to 24.8 wt % nickel, b) 0.2 to 4.7 wt % nickel oxide, c) 0.05 to 3 wt % at least one additive selected from the group consisting of vanadium, manganese, chromium, thallium, titanium, cobalt, and tungsten carbide, d) the balance silver; and said nickel being in the form of essentially pure nickel particles, said nickel oxide being in the form of essentially pure nickel oxide particles, and said additive being in the form of essentially pure additive particles, all said particles being dispersed in a silver matrix for strengthening said contact martial.

2. The silver base electric contact material as set forth in claim 1 wherein said nickel particles comprise micron particles having an average particle diameter of 1 to 20 μm and submicron particles having an average particle diameter of 1 μm or less, said nickel oxide particles being submicron particles having an average particle diameter of 1 μm or less, and said additive particles being micron particles having an average particle diameter of 10 μm or less.

* * * * *